US007144270B2

(12) United States Patent
Wang et al.

(10) Patent No.: US 7,144,270 B2
(45) Date of Patent: Dec. 5, 2006

(54) ELECTRICAL CONNECTOR FOR A FLEXIBLE PRINTED BOARD

(75) Inventors: Eric Wang, Taipei Hsien (TW); Ming-Chung Wang, Taipei Hsien (TW)

(73) Assignee: Advanced Connection Technology Inc., Taipei Hsien (TW)

( * ) Notice: Subject to any disclaimer, the term of this patent is extended or adjusted under 35 U.S.C. 154(b) by 0 days.

(21) Appl. No.: 11/341,270

(22) Filed: Jan. 26, 2006

(65) Prior Publication Data

US 2006/0189204 A1 Aug. 24, 2006

(30) Foreign Application Priority Data

Feb. 23, 2005 (TW) ..... 94105394 A

(51) Int. Cl.
*H01R 12/24* (2006.01)

(52) U.S. Cl. ..... 439/495; 439/329; 439/260

(58) Field of Classification Search ..... 439/495, 439/329, 260
See application file for complete search history.

(56) References Cited

U.S. PATENT DOCUMENTS 5,074,797 A * 12/1991 Yamada ..... 439/62
5,498,169 A * 3/1996 Ikemoto ..... 439/260
6,036,520 A * 3/2000 Tojo ..... 439/260

* cited by examiner

*Primary Examiner*—Truc Nguyen
(74) *Attorney, Agent, or Firm*—Darby & Darby

(57) ABSTRACT

An electrical connector includes a mounting block and a plurality of unitary terminal pieces. The mounting block has a base portion and a projecting portion extending from the base and through an opening unit in an assembly of a flexible printed board and an insulating seat. Each terminal piece has a contact section extending into a receiving slot in the base portion and in electrical contact with a conductive contact of the printed board, and an anchoring section extending through the opening unit and a positioning groove in the projecting portion and having a free end extending toward the contact section. As such, the printed board, the insulating seat and the projecting portion are clamped between the contact section and the anchoring section of each terminal piece.

7 Claims, 6 Drawing Sheets

ELECTRICAL CONNECTOR FOR A FLEXIBLE PRINTED BOARD

CROSS-REFERENCE TO RELATED APPLICATION

This application claims priority of Taiwanese Application No. 094105394, filed on Feb. 23, 2005.

BACKGROUND OF THE INVENTION

1. Field of the Invention

The invention relates to an electrical connector, more particularly to an electrical connector that can be easily assembled to a flexible printed board 2. Description of the Related Art FIGS. 1 to 3 illustrate a conventional electrical connector 1 for connecting electrically a flat ribbon cable 2 to a circuit board (not shown). The flat ribbon cable 2 has one end portion formed with a plurality of conductive terminals 21. The conventional electrical connector 1 includes a mounting block 11, a plurality of terminal pieces 12 mounted on the mounting block 11 and aligned in a transverse direction, and a pressing block 13 connected pivotally to the mounting block 11. Each terminal piece 12 has a contact section 120 and an inverted L-shaped support section 123, wherein the contact section 120 has a connecting end portion 122 welded to the circuit board, a contact end portion 121 opposite to the connecting end portion 122 and contacting electrically a corresponding one of the conductive terminals 21, and an intermediate portion 125 interconnecting the connecting end portion 122 and the contact end portion 121. The pressing block 13 is pivotable relative to the mounting block 11, and is formed with an opening 132 extending in the transverse direction.

The pressing block 13 is operable so as to move between a pressing position and a releasing position. In the pressing position, the pressing block 13 presses against the end portion of the flat ribbon cable 2 such that the conductive terminals 21 are securely clamped between the pressing block 13 and the contact end portions 121 of the terminal pieces 12, as shown in FIG. 3. In the releasing position, the pressing block 13 is removed from the end portion of the flat ribbon cable 2, and a free end 1231 of the support section 123 of each terminal piece 12 extends into the opening 132 in the pressing block 13. As such, the pressing block 13 is supported by the support sections 123 of the terminal pieces 12, as shown in FIG. 2.

Since the conventional connector 1 is generally designed to a small size with specifications of about a 17 mm-length, 3 mm-width and 0.9 mm-height, it is difficult to operate manually during assembly.

SUMMARY OF THE INVENTION

Therefore, the object of the present invention is to provide an electrical connector that can be fabricated at a lower cost and that can be easily assembled to a flexible printed board.

According to one aspect of the present invention, there is provided an electrical connector for a flexible printed board. The flexible printed board has an end portion that has a first surface mounted with a flexible insulating seat thereon, and a second surface opposite to the first surface. An assembly of the flexible printed board and the insulating seat is formed with an opening unit. The second surface is formed with a plurality of conductive contacts aligned in a transverse direction of the flexible printed board and disposed adjacent to the opening unit in the assembly of the flexible printed board and the insulating seat. The electrical connector comprises:

a mounting block having a base portion that has an abutting surface adapted to face the second surface of the flexible printed board and formed with a plurality of parallel receiving slots corresponding respectively to the conductive contacts on the second surface of the end portion of the flexible printed board, and a projecting portion projecting from the abutting surface of the base portion, adapted to pass through the opening unit in the assembly of the flexible printed board and the insulating seat, and formed with a plurality of open-ended positioning grooves that correspond respectively to the receiving slots; and a plurality of resilient clamp-shaped terminal pieces mounted on the mounting block, each of the terminal pieces having a contact section received in a respective one of the receiving slots and having a connecting end portion extending outwardly of the respective one of the receiving slots, and a contact end portion opposite to the connecting end portion and adapted to be in electrical contact with a corresponding one of the conductive contacts of the flexible printed board, and an anchoring section having a coupling end portion extending from the connecting end portion of the contact section and adapted to extend through the opening unit in the assembly of the flexible printed board and the insulating seat, a free end portion opposite to the coupling end portion and disposed outwardly of the projecting portion of the mounting block, and an intermediate portion interconnecting the coupling end portion and the free end portion and extending through a corresponding one of the positioning grooves in the projecting portion of the mounting block so as to clamp the insulating seat, the flexible printed board and the mounting block between the contact section and the anchoring section of each of the terminal pieces, the free end portion extending from the intermediate portion toward the contact section so as to prevent removal of the mounting block from each of the terminal pieces.

According to another aspect of the present invention, a connector assembly comprises:

a flexible printed board having an end portion that has a first surface mounted with a flexible insulating seat thereon, and a second surface opposite to the first surface, an assembly of the flexible printed board and the insulating seat being formed with an opening unit, the second surface being formed with a plurality of conductive contacts aligned in a transverse direction of the flexible printed board and disposed adjacent to the opening unit in the assembly of the flexible printed board and the insulating seat; and an electrical connector including a mounting block having a base portion that has an abutting surface facing the second surface of the flexible printed board and formed with a plurality of parallel receiving slots corresponding respectively to the conductive contacts on the second surface of the end portion of the flexible printed board, and a projecting portion projecting from the abutting surface of the base portion, passing through the opening unit in the insulating seat, and formed with a plurality of open-ended positioning grooves that correspond respectively to the receiving slots, and a plurality of resilient clamp-shaped terminal pieces mounted on the mounting block, each of the terminal pieces having a contact section received in a respective one of the receiving slots and having a connecting end portion extending outwardly of the respective one of the receiving slots, and a contact end portion opposite to the connecting end portion, and an anchoring section having a coupling end portion extending from the connecting end portion of the contact section and through the opening unit in the assembly of the flexible printed board and the insulating seat, a free end portion opposite to the coupling end portion and disposed outwardly of the projecting portion of the mounting block, and an intermediate portion interconnecting the coupling end portion and the free end portion and extending through a corresponding one of the positioning grooves in the projecting portion of the mounting block so as to clamp the insulating seat, the flexible printed board and the mounting block between the contact section and the anchoring section of each of the terminal pieces, the free end portion extending from the intermediate portion toward the contact section so as to prevent removal of the mounting block from each of the terminal pieces.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
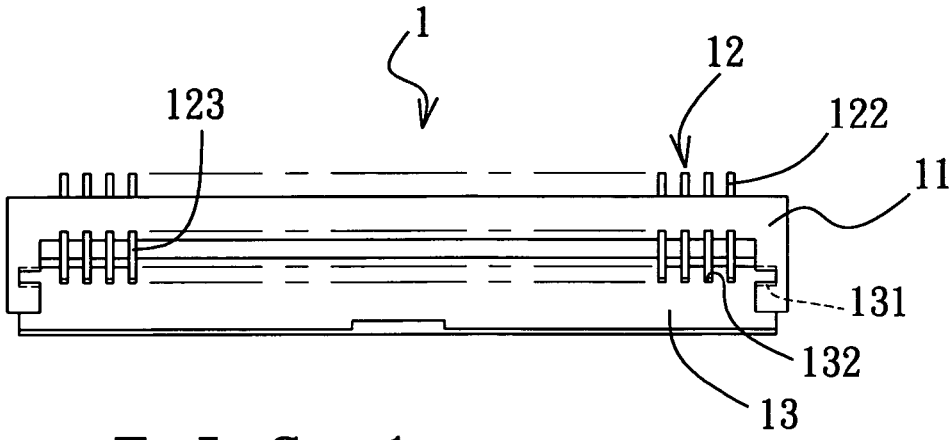
F I G. 1 PRIOR ART
FIG. 1 is a schematic top view of a conventional electrical connector.
Figure 2:
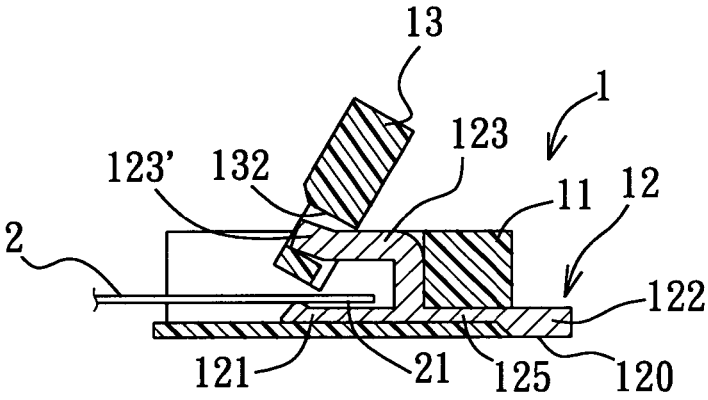
F I G. 2 PRIOR ART
FIG. 2 is a schematic sectional view illustrating how a flat ribbon cable is assembled to the conventional electrical connector.
Figure 3:
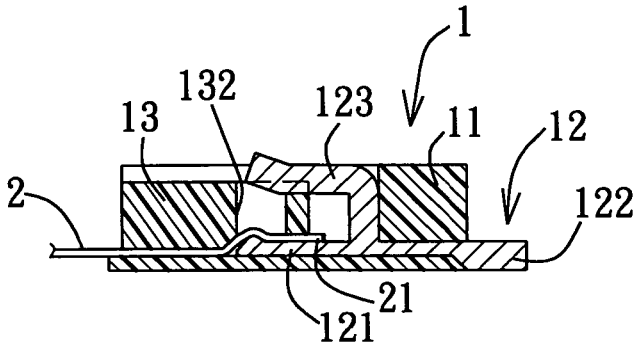
F I G. 3 PRIOR ART
FIG. 3 is a schematic sectional view illustrating an assembly of the flexible printed board and the conventional electrical connector.

Before the present invention is described in greater detail, it should be noted that like elements are denoted by the same reference numerals throughout the disclosure.

Figure 4:
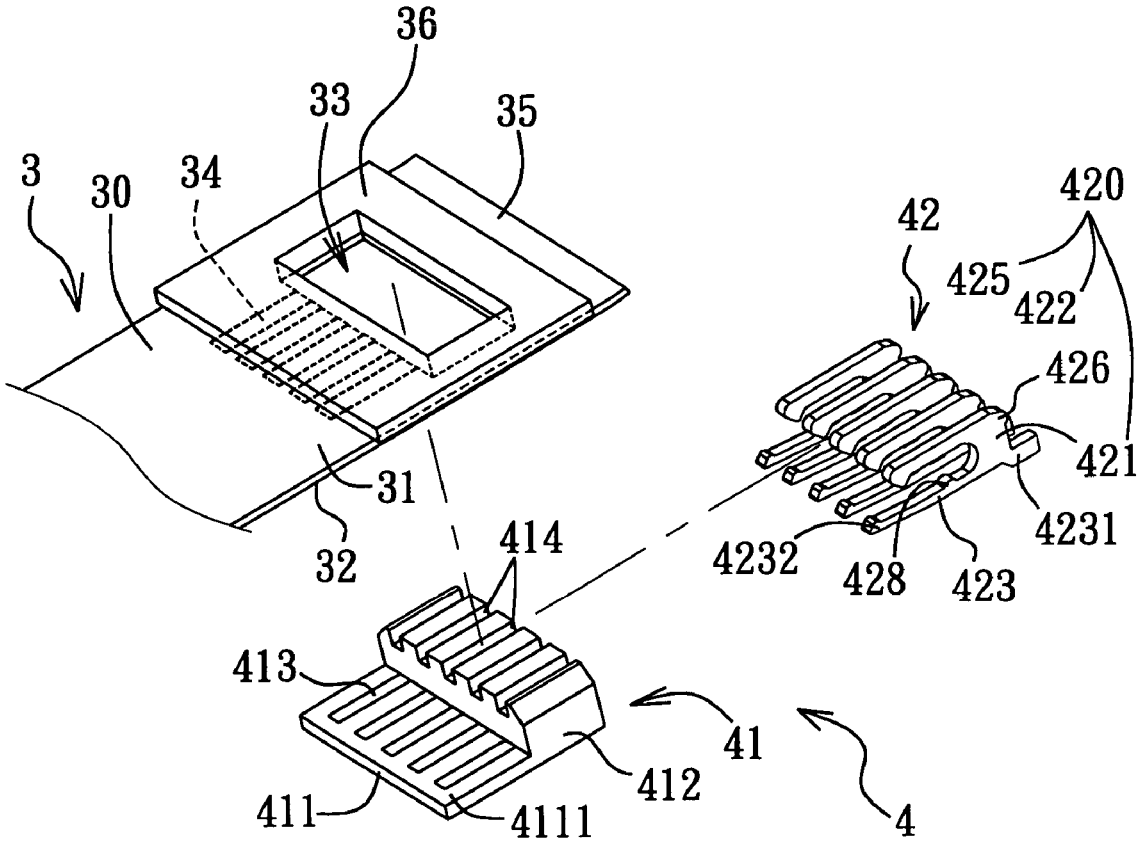
FIG. 4 is a fragmentary exploded perspective view showing the first preferred embodiment of a connector assembly according to the present invention.
Figure 5:
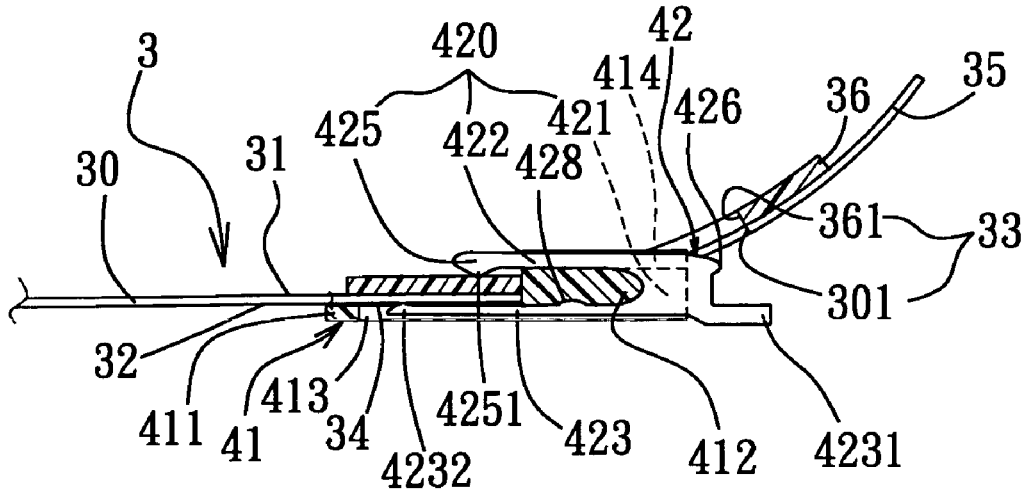
FIG. 5 is a fragmentary schematic sectional view of the first preferred embodiment illustrating how an electrical connector is assembled to an assembly of a flexible printed board and an insulating seat.
Figure 6:
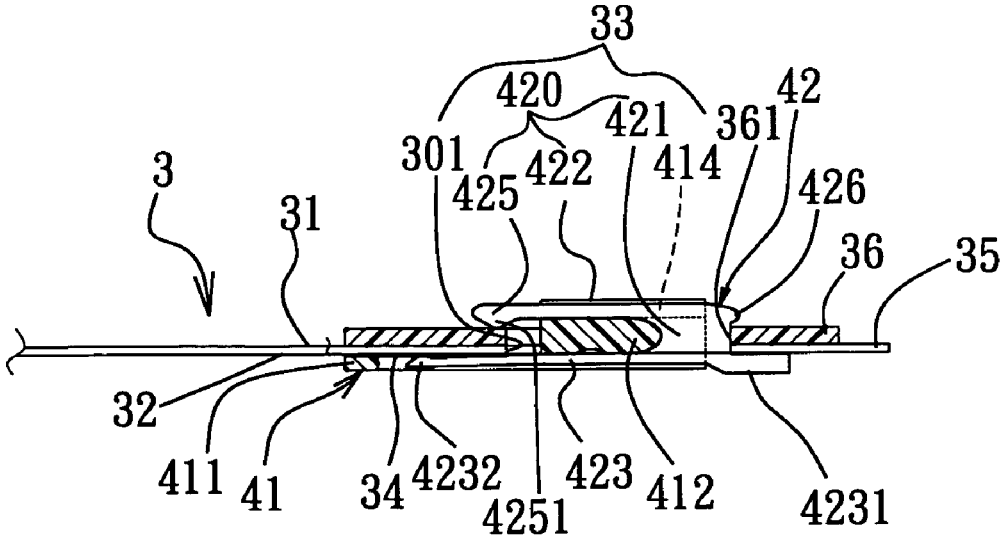
FIG. 6 is a fragmentary schematic sectional view showing the first preferred embodiment.

Referring to FIGS. 4 to 6, the first preferred embodiment of a connector assembly according to the present invention is shown to include a flexible printed board 3, and an electrical connector 4.

The flexible printed board 3 has an end portion 30 that has a first surface 31 mounted with a flexible insulating seat 36 thereon, and a second surface 32 opposite to the first surface 31. An assembly of the flexible printed board 3 and the insulating seat 36 is formed with an opening unit 33. The second surface 32 is formed with a plurality of conductive contacts 34 aligned in a transverse direction of the flexible printed board 3 and disposed adjacent to the opening unit 33 in the insulating seat 36. In this embodiment, the whole of the insulating seat 36 is fixedly mounted on the first surface 31 of the end portion 30 of the flexible printed board 3. The flexible printed board 3 further has an operating extension 35 for manual operation. The opening unit 33 is disposed between the operating extension 35 and the conductive contacts 34. In this embodiment, the opening unit 33 consists of a first through hole 361 formed in the insulating seat 36, and a second through hole 301 formed in the end portion 30 of the flexible printed board 3, as shown in FIGS. 5 and 6.

The electrical connector 4 includes a mounting block 41, and a plurality of resilient clamp-shaped terminal pieces 42 mounted on the mounting block 41.

The mounting block 41 has a base portion 411 that has an abutting surface 4111 facing the second surface 32 of the flexible printed board 3 and formed with a plurality of parallel receiving slots 413 corresponding respectively to the conductive contacts 34 on the second surface 32 of the end portion 30 of the flexible printed board 3, and a projecting portion 412 projecting from the abutting surface 4111 of the base portion 411, passing through the opening unit 33 in the assembly of the flexible printed board 3 and the insulating seat 36, and formed with a plurality of open-ended positioning grooves 414 that correspond respectively to the receiving slots 413.

Each of the terminal pieces 42 has a contact section 423 received in a respective one of the receiving slots 413 and having a connecting end portion 4231 extending outwardly of the respective one of the receiving slots 413 and adapted to be welded to a circuit board (not shown), and an L-shaped anchoring section 420 having a coupling end portion 421 extending from the connecting end portion 4231 of the contact section 423 and extending through the opening unit 33 in the assembly of the flexible printed board 3 and the insulating seat 36, a free end portion 425 opposite to the coupling end portion 421 and disposed outwardly of the projecting portion 412 of the mounting block 41, and an intermediate portion 422 interconnecting the coupling end portion 421 and the free end portion 425 and extending through a corresponding one of the positioning grooves 414 in the projecting portion 412 of the mounting block 41 so as to clamp the insulating seat 36, the flexible printed board 3 and the mounting block 41 between the contact section 423 and the anchoring section 420 of each of the terminal pieces 42. The free end portion 425 extends from the intermediate portion 422 toward the contact section 423 so as to prevent removal of the mounting block 41 from each of the terminal pieces 42. In this embodiment, for each terminal piece 42, the contact section 423 is formed with a protrusion 428 that abuts against the projecting portion 412 of the mounting block 41, and the free end portion 425 of the anchoring section 420 is formed with a protrusion 4251 that abuts against the insulating seat 36 when the electrical connector 4 is assembled to the flexible printed board 3. Furthermore, the coupling end portion 421 of the anchoring section 420 of each terminal piece 42 is formed with an integral stop stub 426 extending away from the intermediate portion 422 of the anchoring section 420 of a corresponding one of the terminal pieces 42 so as to confine the insulating seat 36 and the flexible printed board 3 between the stop stub 426 and the connecting end portion 4231 of the contact section 423 of the corresponding one of the terminal pieces 42, as shown in FIG. 6.

Figure 7:
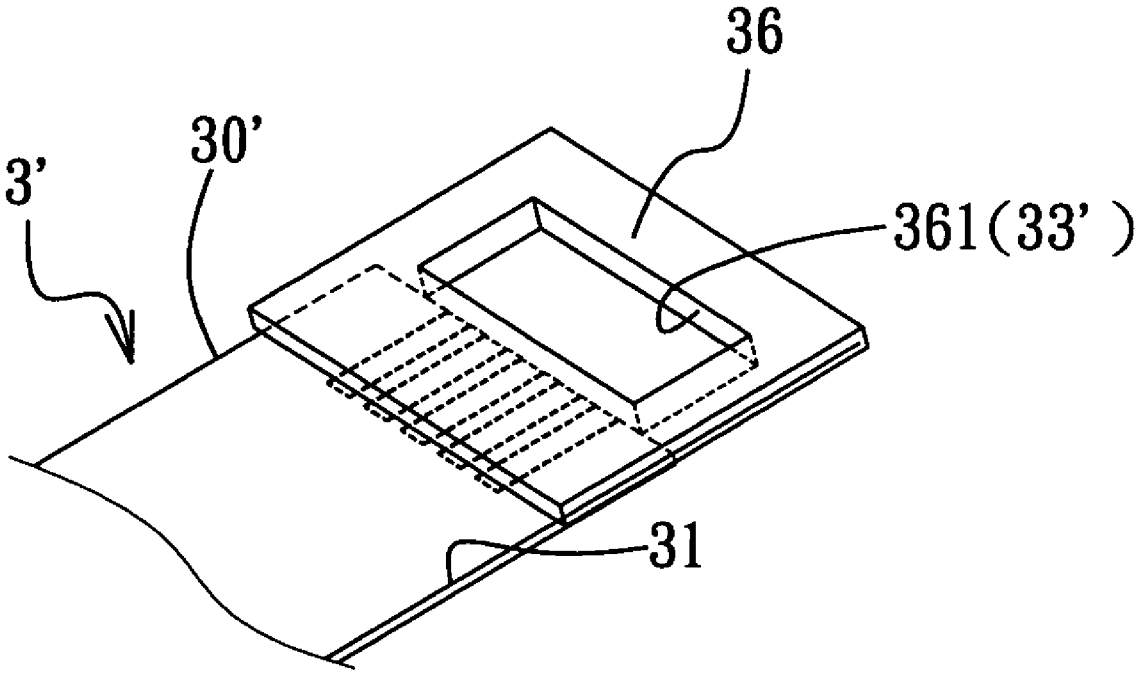
FIG. 7 is a fragmentary perspective view showing a modification of the assembly of the flexible printed board and the insulating seat of the first preferred embodiment.

FIG. 7 illustrates a modified assembly of the flexible printed board 3' and the insulating seat 36 in the first preferred embodiment. In this case, only a part of the insulating seat 36 is fixed on the first surface 31 of the end portion 30', and the remaining of the insulating seat 36 is extended outwardly from the end portion 30'. With this configuration, the through hole 361 in the insulating seat 36 serves as the opening unit 33'.

Figure 8:
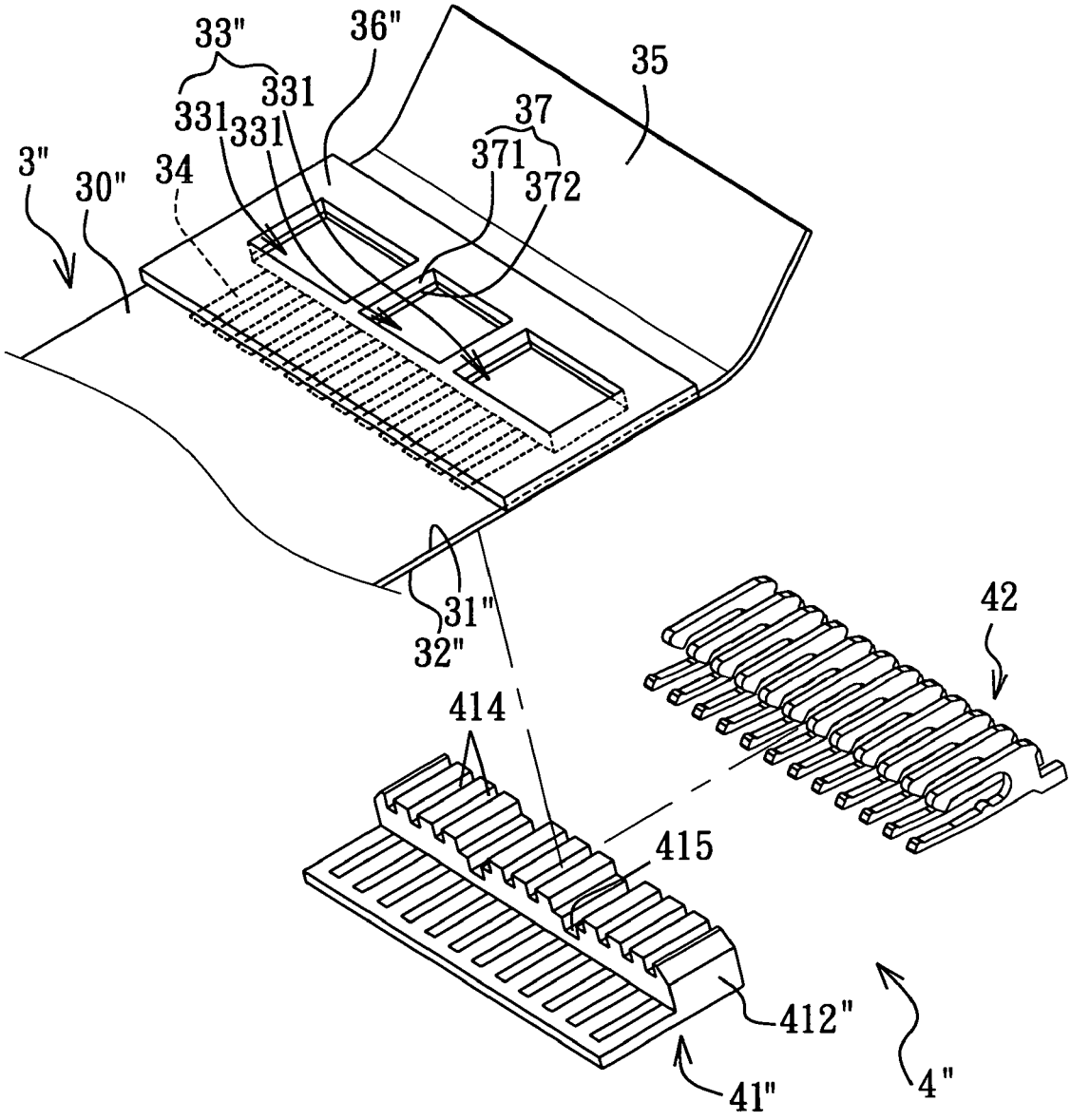
FIG. 8 is a fragmentary exploded perspective view showing the second preferred embodiment of a connector assembly according to the present invention.
Figure 9:
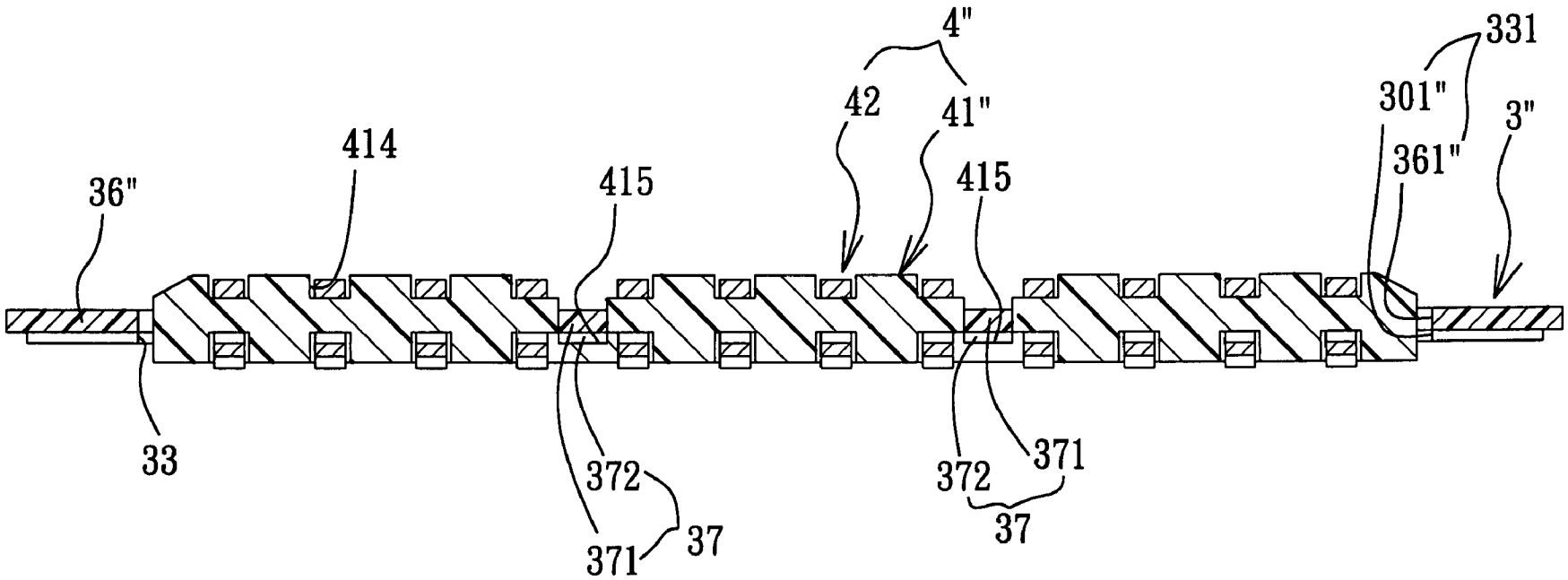
FIG. 9 is an assembled schematic sectional view showing the second preferred embodiment.

FIGS. 8 and 9 illustrate the second preferred embodiment of a connector assembly according to this invention, which is a modification of the first preferred embodiment. In this embodiment, the opening unit 33" includes a plurality of openings 331 aligned in the transverse direction such that a partitioning rib 37 is formed between each adjacent pair of the openings 331. Each opening 331 consists of a first through hole 361" formed in the insulating seat 36", and a second through hole 301" formed in the end portion 30" of the flexible printed board 3". As such, each partitioning rib 37 has a first rib portion 371 formed between each adjacent pair of the first through holes 361" in the insulating seat 36", and a second rib portion 372 formed between each adjacent pair of the second through holes 301" in the end portion 30" of the flexible printed board 3". The projecting portion 412" of the mounting block 41" is further formed with a plurality of rib-receiving grooves 415 for receiving respectively the partitioning ribs 37. With such a configuration, the connector assembly of the second preferred embodiment permits connection with a circuit board having more contacts.

In summary, by manual operation of the operating extension 35, the projecting portion 41, 41" of the mounting block 41, 41" mounted with the terminal pieces 42 can be easily assembled to or disassembled from the flexible printed board 3, 3". Furthermore, the resilient clamp-shaped terminal pieces 42 can clamp the flexible printed board 3, 3" and the mounting block 41, 41" between the contact sections 423 and the anchoring sections 420 without the need of any component for securing the flexible printed board 3, 3" to the mounting block 41, 41" such that the electrical connector 4, 4" of this invention can be fabricated at a lower cost than with conventional configurations. The object of the invention is thus met.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An electrical connector for a flexible printed board, the flexible printed board having an end portion that has a first surface mounted with a flexible insulating seat thereon, and a second surface opposite to the first surface, an assembly of the flexible printed board and the insulating seat being formed with an opening unit, the second surface being formed with a plurality of conductive contacts aligned in a transverse direction of the flexible printed board and disposed adjacent to the opening unit in the assembly of the flexible printed board and the insulating seat, said electrical connector comprising:

a mounting block having a base portion that has an abutting surface adapted to face the second surface of the flexible printed board and formed with a plurality of parallel receiving slots adapted to correspond respectively to the conductive contacts on the second surface of the end portion of the flexible printed board, and a projecting portion projecting from said abutting surface of said base portion, adapted to pass through the opening unit in the assembly of the flexible printed board and the insulating seat, and formed with a plurality of open-ended positioning grooves that correspond respectively to said receiving slots; and a plurality of resilient clamp-shaped terminal pieces mounted on said mounting block, each of said terminal pieces having a contact section received in a respective one of said receiving slots and having a connecting end portion extending outwardly of the respective one of said receiving slots, and a contact end portion opposite to said connecting end portion and adapted to be in electrical contact with a corresponding one of the conductive contacts of the flexible printed board, and an anchoring section having a coupling end portion extending from said connecting end portion of said contact section and adapted to extend through the opening unit in the assembly of the flexible printed board and the insulating seat, a free end portion opposite to said coupling end portion and disposed outwardly of said projecting portion of said mounting block, and an intermediate portion interconnecting said coupling end portion and said free end portion and extending through a corresponding one of said positioning grooves in said projecting portion of said mounting block so as to clamp the insulating seat, the flexible printed board and said mounting block between said contact section and said anchoring section of each of said terminal pieces, said free end portion extending from said intermediate portion toward said contact section so as to prevent removal of said mounting block from each of said terminal pieces.

2. The electrical connector as claimed in claim 1, the opening unit including a plurality of openings aligned in the transverse direction such that a partitioning rib is formed between each adjacent pair of the openings, wherein said projecting portion is further formed with a plurality of rib-receiving grooves adapted for receiving respectively said partitioning ribs.

3. A connector assembly comprising:

a flexible printed board having an end portion that has a first surface mounted with a flexible insulating seat thereon, and a second surface opposite to the first surface, an assembly of said flexible printed board and said insulating seat being formed with an opening unit, said second surface being formed with a plurality of conductive contacts aligned in a transverse direction of said flexible printed board and disposed adjacent to said opening unit in the assembly of said flexible printed board and said insulating seat; and an electrical connector including a mounting block having a base portion that has an abutting surface facing said second surface of said flexible printed board and formed with a plurality of parallel receiving slots corresponding respectively to said conductive contacts on said second surface of said end portion of said flexible printed board, and a projecting portion projecting from said abutting surface of said base portion, passing through said opening unit in the assembly of said flexible printed board and said insulating seat, and formed with a plurality of open-ended positioning grooves that correspond respectively to said receiving slots, and a plurality of resilient clamp-shaped terminal pieces mounted on said mounting block, each of said terminal pieces having a contact section received in a respective one of said receiving slots and having a connecting end portion extending outwardly of the respective one of said receiving slots, and a contact end portion opposite to said connecting end portion, and an anchoring section having a coupling end portion extending from said connecting end portion of said contact section and through said opening unit in the assembly of said flexible printed board and said insulating seat, a free end portion opposite to said coupling end portion and disposed outwardly of said projecting portion of said mounting block, and an intermediate portion interconnecting said coupling end portion and said free end portion and extending through a corresponding one of said positioning grooves in said projecting portion of said mounting block so as to clamp said insulating seat, said flexible printed board and said mounting block between said contact section and said anchoring section of each of said terminal pieces, said free end portion extending from said intermediate portion toward said contact section so as to prevent removal of said mounting block from each of said terminal pieces.

4. The connector assembly as claimed in claim 3, wherein said free end portion of said anchoring section of each of said terminal pieces is formed with a protrusion that abuts against said insulating seat.

5. The connector assembly as claimed in claim 3, wherein said coupling end portion of said anchoring section of each of said terminal pieces is formed with an integral stop stub extending away from said intermediate portion of said anchoring section of a corresponding one of said terminal pieces so as to confine said insulating seat and said flexible printed board between said stop stub and said connecting end portion of said contact section of the corresponding one of said terminal pieces.

6. The connector assembly as claimed in claim 3, wherein said insulating seat is fixedly mounted on said first surface of said end portion of said flexible printed board, said flexible printed board further having an operating extension for manual operation, said opening unit being disposed between said operating extension and said conductive contacts.

7. The connector assembly as claimed in claim 3, wherein said opening unit includes a plurality of openings aligned in the transverse direction such that a partitioning rib is formed between each adjacent pair of said openings, said projecting portion being further formed with a plurality of rib-receiving grooves for receiving respectively said partitioning ribs.

* * * * *